US008646656B2

(12) United States Patent
Johnson

(10) Patent No.: US 8,646,656 B2
(45) Date of Patent: Feb. 11, 2014

(54) POWER OVER ETHERNET POWERED SOAP OR DISINFECTANT DISPENSER

(76) Inventor: Raymond C. Johnson, Creve Coeur, MO (US)

( * ) Notice: Subject to any disclaimer, the term of this patent is extended or adjusted under 35 U.S.C. 154(b) by 252 days.

(21) Appl. No.: 12/917,998

(22) Filed: Nov. 2, 2010

(65) Prior Publication Data

US 2012/0031922 A1 Feb. 9, 2012

Related U.S. Application Data

(60) Provisional application No. 61/257,196, filed on Nov. 2, 2009.

(51) Int. Cl.
*B67D 1/00* (2006.01)

(52) U.S. Cl.
USPC ..... 222/52; 222/64; 222/63; 340/573.1; 713/300; 713/310; 713/340; 700/275; 700/282

(58) Field of Classification Search
USPC ..... 222/52, 63; 340/573.1, 5.2, 5.83, 340/286.07, 538.1, 12.32; 713/300, 310, 713/340; 307/35, 1
See application file for complete search history.

(56) References Cited

U.S. PATENT DOCUMENTS

| | | | | |
|---|---|---|---|---|
| 6,038,331 | A | 3/2000 | Johnson | |
| 6,125,482 | A * | 10/2000 | Foster | 4/623 |
| 6,970,574 | B1 | 11/2005 | Johnson | |
| 7,142,951 | B2 * | 11/2006 | Pincu et al. | 700/297 |
| 7,152,168 | B2 | 12/2006 | Boynton | |
| 7,154,381 | B2 * | 12/2006 | Lang et al. | 340/12.32 |
| 7,155,622 | B2 * | 12/2006 | Mancey et al. | 713/324 |
| 7,509,505 | B2 * | 3/2009 | Randall et al. | 713/300 |
| 7,542,586 | B2 | 6/2009 | Johnson | |
| 7,734,359 | B2 * | 6/2010 | Deveaux et al. | 700/83 |
| 8,020,013 | B2 * | 9/2011 | Lin | 713/310 |
| 8,249,295 | B2 * | 8/2012 | Johnson | 382/100 |
| 8,352,769 | B1 * | 1/2013 | Ghose et al. | 713/324 |
| 2002/0174182 | A1 * | 11/2002 | Wilkinson et al. | 709/205 |
| 2005/0125083 | A1 * | 6/2005 | Kiko | 700/19 |
| 2005/0171634 | A1 | 8/2005 | York | |
| 2006/0005312 | A1 | 1/2006 | Reddy | |
| 2006/0149978 | A1 * | 7/2006 | Randall et al. | 713/300 |
| 2006/0173576 | A1 | 8/2006 | Goerg | |
| 2007/0057783 | A1 | 3/2007 | Reller | |

(Continued)

FOREIGN PATENT DOCUMENTS

| | | | |
|---|---|---|---|
| WO | 2007071001 | A2 | 6/2007 |
| WO | WO2007/071001 | * | 6/2007 |

OTHER PUBLICATIONS

International Search Report from PCT/US2011/058499, May 2, 2013.

(Continued)

*Primary Examiner* — Frederick C Nicolas
*Assistant Examiner* — Bob Zadeh
(74) *Attorney, Agent, or Firm* — Grace J. Fishel

(57) ABSTRACT

A system for providing power to a plurality of soap or disinfectant dispensers through a power over ethernet (PoE) network and for sensing various operational parameters of the dispensers and communicating those parameters through the network connection to a central computing device. The system includes a Data/Power controller associated with the dispensers for providing power to the dispenser and for sending and receiving data between one or more sensors in the dispensers and a central computer device.

12 Claims, 2 Drawing Sheets

(56) References Cited

U.S. PATENT DOCUMENTS

| | | | | |
|---|---|---|---|---|
| 2007/0075586 | A1 | 4/2007 | Bogue | |
| 2007/0112446 | A1* | 5/2007 | Deveaux et al. | 700/83 |
| 2007/0213877 | A1* | 9/2007 | Hart et al. | 700/282 |
| 2007/0236346 | A1 | 10/2007 | Helal | |
| 2007/0274322 | A1* | 11/2007 | Hansalia | 370/395.53 |
| 2008/0028237 | A1* | 1/2008 | Knight | 713/300 |
| 2009/0119142 | A1 | 5/2009 | Yenni | |
| 2009/0195385 | A1 | 8/2009 | Huang | |
| 2009/0212956 | A1* | 8/2009 | Schuman et al. | 340/573.1 |
| 2009/0219131 | A1* | 9/2009 | Barnett et al. | 340/5.2 |
| 2009/0228722 | A1 | 9/2009 | Lin | |
| 2010/0134296 | A1* | 6/2010 | Hwang | 340/573.1 |
| 2010/0155416 | A1 | 6/2010 | Johnson | |
| 2010/0328076 | A1* | 12/2010 | Kyle et al. | 340/573.1 |
| 2012/0031922 | A1* | 2/2012 | Johnson | 222/23 |

OTHER PUBLICATIONS

International Written Opinion from PCT/US2011/058499, May 2, 2013.

* cited by examiner

POWER OVER ETHERNET POWERED SOAP OR DISINFECTANT DISPENSER

This application claims priority from provisional application Ser. No. 61/257,196, filed Nov. 2, 2009, for Power Over Ethernet Powered Soap Or Disinfectant Dispenser.

BACKGROUND OF THE INVENTION

1. Field of the Invention

The present invention relates to a system for providing power to a plurality of soap or disinfectant dispensers through a power over ethernet (PoE) network and for sensing various operational parameters of the dispensers and communicating those parameters through the network connection to a central computing device.

2. Brief Description of the Prior Art

It is known that poor hand cleaning compliance in the medical and food industries is a source of infectious disease. It is also known that hand cleaning compliance increases if an employee knows that management is monitoring compliance. Similarly it is known that hand cleaning compliance also increases if the soap or disinfectant dispensers are in good operating condition.

BRIEF SUMMARY OF THE INVENTION

In view of the above, it is an object of the present invention to provide a system for providing power to a plurality of soap or disinfectant dispensers through a controller that includes a power distribution system and which optionally sends and receives data between the dispensers and a central computing device regarding conditions in the dispensers. Other objects and features of the invention will be in part apparent and in part pointed out hereinafter.

In accordance with the invention, a system for powering a soap or disinfectant dispenser through a power over ethernet network is disclosed. The system includes a controller having a power distribution system with an interface connected to the dispenser for providing power to the dispenser. Optionally, the controller also receives and sends data between one or more sensors in the dispenser and a central computing device. The controller may be internal or external to the dispenser and an integrated circuit or a microprocessor. The sensors may sense the operational status of a component of the dispenser or the presence of a user.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
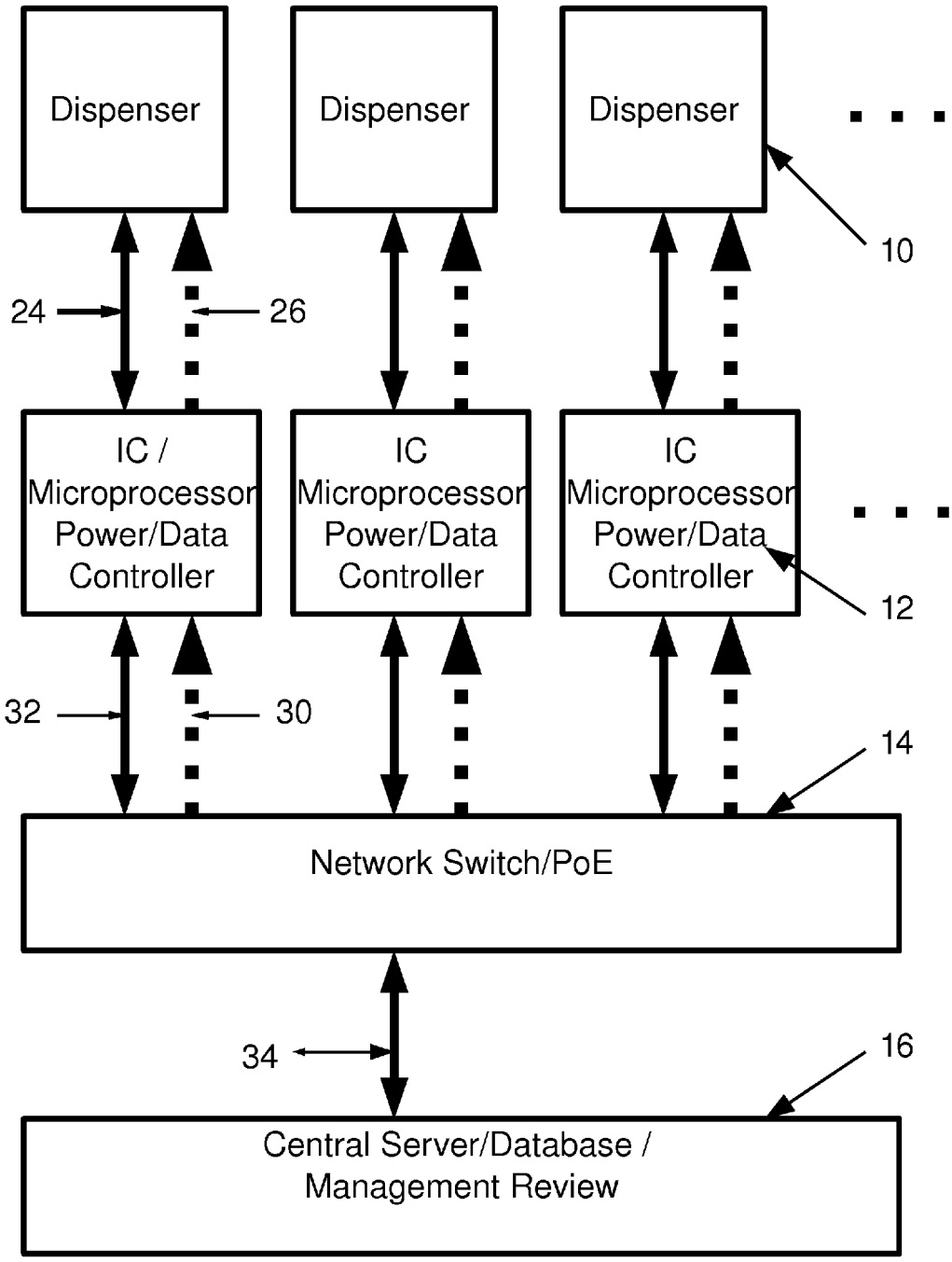
FIG. 1 is a schematic drawing showing a system with Power/Data Controllers in accordance with the present invention; and, FIG. 2 is a schematic drawing showing a system wherein the Power/Data Controllers are physically located in the dispensers.

FIG. 1 shows the architecture of the present invention wherein a networked system of soap or disinfectant dispensers is shown. The dispensers (10) include sensors (28) and are connected to a central database server (16) via a standard power over ethernet (PoE) network switch (14). The present invention includes a Power/Data Controller (12) which is shown on the network between the dispensers and the network switch.

Dispensers (10) may be touchless and operate with a variety of electrical and electromechanical components to automatically dispense a metered amount of soap, anti-bacterial cleansing liquid, lotion or the like. Such dispensers (10) typically have a discharge port for metering the cleanser into the hands of a user and a detector which triggers operation of the dispensing mechanism on receipt of a signal from a detector. The detector can be a proximity switch with an optical, voice, infrared, magnetic, ultrasonic and the like sensor. Biometric data such as a voice print, fingerprint, palm scan, retinal scan or the like may be taken by an input device responsive to a detector (28) sent to and interpreted by a central database server (16). A reply signal (26) may be sent providing feedback to the user. When detector (28) is a status sensor for detecting conditions in the dispensers (10) information is sent through the network bidirectionally between dispenser (10) and central database server (16). Other than for the status sensors and the Power/Data Controller (12) the foregoing is known in the art and needs no further explanation.

The Power/Data Controller can be an integrated circuit or a microprocessor and may be physically located near the dispensers or, in an alternative form of the invention, they may be located inside the dispenser housing. The Power/Data Controller includes a network interface, a power distribution system and various electrical and/or HID (human Interface Device) interfaces necessary to perform the functions of optionally providing power to the dispenser and optionally receiving and sending data between detectors and sensors (28) in the soap dispenser, any associated HID devices, and a central computer on the network. The Power/Data Controller will manage sending any necessary command data to any sensors included in the dispenser (24) and will receive sensor information (24) and pass it back to the central database server via the network switch (32, 34).

From the above, it is seen that controller (12) can both provide power and send data. The two concepts are related in that both require connecting the dispensers to a computer network. In case (1) the network is used to send and receive data, in case (2) the network is used to provide power, but does not necessarily have to send and receive data. In situation (3) the Power/Data Controller does both: Power the dispenser from the network and send and receive data to and from the dispensers.

In the first case the Power/Data Controller may act solely as a Data Controller for the dispenser wherein it accepts data sent to it from the various sensors in the dispenser, as well as data from any associated HID devices such as microphones, cameras, fingerprint readers, RFID readers, etc. and sends this information to a central network computer. In this case it will also accept information from the central network computer and send this information to the relevant sensor or HID devices, for example to tell the unit to display on an LCD the name of an employee identified by a fingerprint reader or other HID device Like the PoE/Data Controller itself, any sensors or HID devices may be either external or internal to the dispenser housing.

In the second case, when the network switch is a PoE switch providing power to the Power/Data Controller (30), then the Power/Data Controllers may provide PoE power to the dispenser (26) sufficient to completely power all functions of the dispenser, including the dispenser motor, motor controller circuit and any sensors, such as a low-soap condition sensor, hand presence sensor, missing soap cartridge senor or other dispenser status sensors which may be included in the dispenser.

In the third case and switch (14) is both a network switch and a PoE switch, the Power/Data Controller may act as both a Power and Data Controller performing all the functions mentioned in the previous two cases.

In previous networked soap or disinfectant dispensers, data sent from the dispensers was limited to a signal indicating that the dispenser had been activated causing it to dispense soap or disinfectant. Bidirectional information was limited to biometric data sent from detectors associated with the dispenser for use in identifying the employee and feedback to the employee about the identification. In the present system, the data sent from the dispensers also includes information regarding conditions in the dispenser. It may also include site specific information which can be particularized down to a single dispenser. Data about any such site specific condition may be sent to the central database server so that either a manager can be notified or the condition can be processed by the central computer, or alternatively, the condition may be entirely processed by the Power/Data Controller itself. Site specific adjustments can be made, for example a larger aliquot of soap may be required for employees in a particular work environment or a speaker must be louder or softer depending on background noise.

Examples of data regarding conditions in the dispenser that may be sent from a dispenser to a central server include:

Low soap indication. A sensor in the dispenser senses that the unit is almost out of soap. The Data Controller would then send a message from the sensor over the network to the central computer where a program would cause a message to appear on a manager's computer informing the manager that a particular dispenser was almost out of soap.

Self-diagnostics. Sensors in the dispenser would detect a hardware failure such as a motor failure or a failure of the hand sensing circuitry. This information would then be sent to the central computer via the Data Controller and network and message would inform a manger of the failure and the need to replace the dispenser.

Examples of data that may be sent from the central server to the dispenser include:

Soap aliquot command. If a manager notices that employees are triggering the soap dispenser multiple time indicating that aliquot of soap dispensed is inadequate, using software in the central computer the manager may send a message to the dispenser telling it to set the quantity of soap dispensed to a higher value, e.g., from 1 fluid ounce to 2.

Reminder messages. Using programs on the central computer, a hand washing reminder message may be sent to the dispenser for display on a small LCD display embedded in the dispenser.

Examples of data regarding site specific conditions observed by a user that may be sent by a user through the dispenser to a central server or processed by the Power/Data Controller include:

Screen contrast on the dispenser wrong color, too bright or dim.

Lack of towels, malfunction of hand dryer, toilet overflowing, etc. This information may be communicated through the network to a manager through a microphone associated with the dispenser. Keywords such as "problem" may be used. For example, "Problem, screen too bright," "Problem, microphone too low," or "Problem, patient lying on floor."

Figure 2:
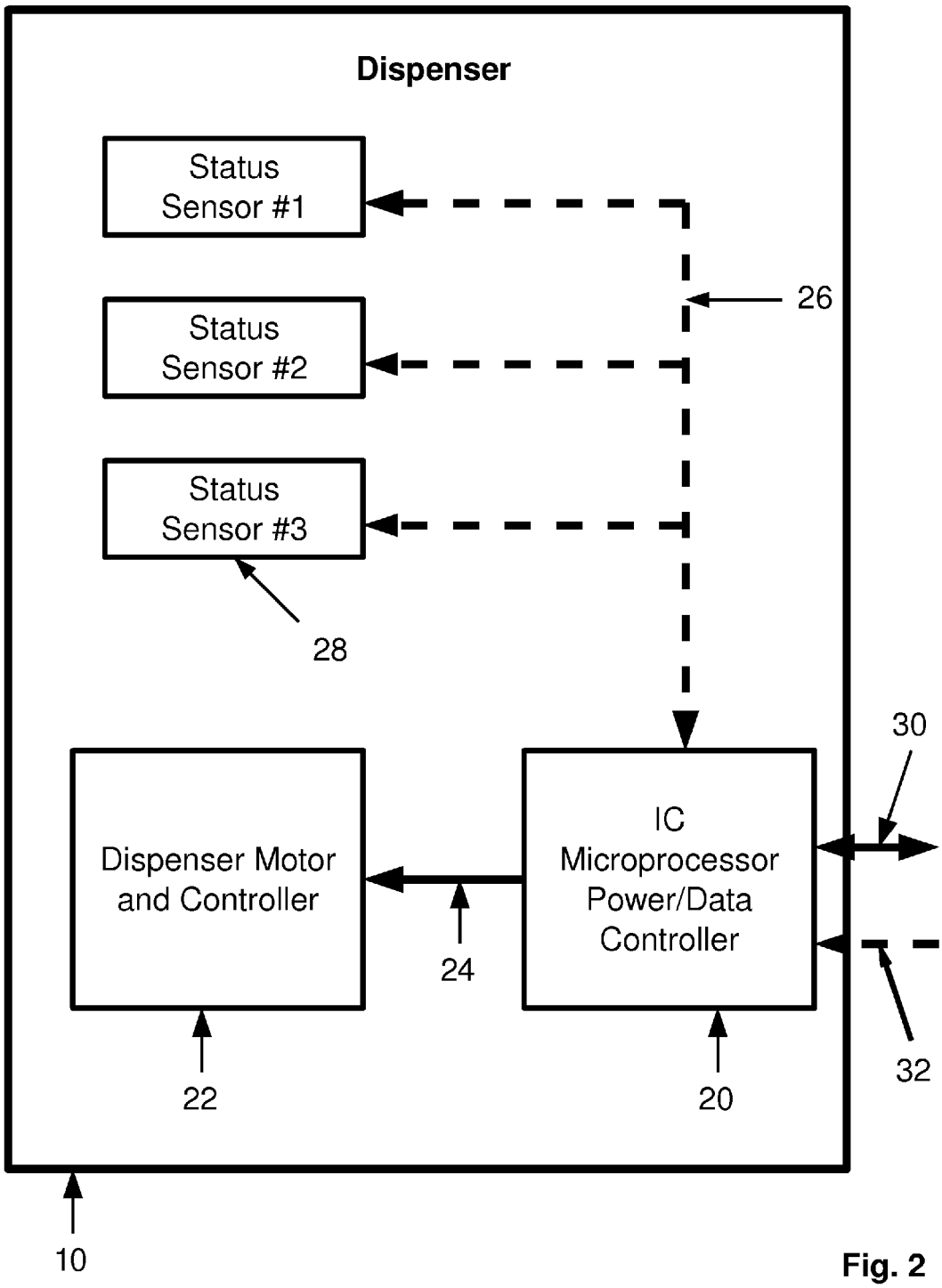

FIG. 2 shows the form of the present invention in which the Power/Data Controller (20) is physically located inside the dispenser (10). The Power/Data Controller communicates bi-directionally (26) with any status sensors or accessory systems included in the dispenser (28). In addition, the Power/Data Controller may optionally provide power (24) to the dispenser motor and motor controller (22). The Power/Data Controller in the dispenser is connected to the local area network for bidirectional data transfer (30) and to receive PoE power from the network (32).

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A system adapted to be connected to a central server through a PoE network switch in a PoE network, said system powering a soap or disinfectant dispenser through a power/data controller connected to the PoE network switch, said power/data controller consisting of a power distribution system with a first interface connected to the dispenser for providing power to the dispenser, said power distribution system also with a second interface continuously available for passing data between the soap or disinfectant dispenser and the central server through the controller and the PoE switch.

2. The system of claim 1 wherein a plurality of touchless dispensers are connected to the PoE network through a power/data controller with a power distribution system.

3. The system of claim 1 wherein the power/data controller is an integrated circuit or a microprocessor.

4. The system of claim 1 wherein the power over ethernet network supplies sufficient power to the dispenser to power dispenser hand or motion sensors, a soap or disinfectant dispensing mechanism and all internal dispenser control circuitry.

5. The system of claim 4 wherein the power/data controller also receives and sends data between one or more sensors in the dispenser and the central server.

6. The system of claim 5 wherein the one or more sensors are internal to the dispenser and sense an operation status of a component of the dispenser.

7. The system of claim 6 wherein one of the sensors is capable of sensing a low soap condition.

8. The system of claim 6 wherein one of the sensors is capable of sensing a failure of a soap or disinfectant dispensing mechanism in the dispenser.

9. The system of claim 6 wherein one of the sensors detects a presence of a hand under a discharge port of the dispenser.

10. The system of claim 9 wherein the power/data controller sends a report to the central server which identifies the dispenser and a date and time of each dispensing act.

11. The system of claim 9 further comprising an input device co-located with each dispenser for acquiring identification information about a user, said input device sending a signal to the power/data controller which sends a report to the central server, said central server identifying the user with an algorithm appropriate to the information acquired by the input device, said central server storing the identify of the user in a database along with the identify of the dispenser and a date and time of the dispensing act.

12. The system of claim 11 wherein an output device is co-located with each dispenser for providing feedback to the user regarding use of the dispenser.

* * * * *